US008094023B1

(12) United States Patent
El-Kady et al.

(10) Patent No.: US 8,094,023 B1
(45) Date of Patent: Jan. 10, 2012

(54) PHONONIC CRYSTAL DEVICES

(75) Inventors: Ihab F. El-Kady, Albuquerque, NM (US); Roy H. Olsson, Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 337 days.

(21) Appl. No.: 12/394,831

(22) Filed: Feb. 27, 2009

Related U.S. Application Data

(60) Provisional application No. 61/035,148, filed on Mar. 10, 2008.

(51) Int. Cl.
*G08B 13/14* (2006.01)

(52) U.S. Cl. ..... 340/572.1; 340/568.1; 340/539.1; 340/586

(58) Field of Classification Search .... 340/572.1–572.9, 340/568.1, 539.1, 586.1, 622, 643, 660, 586
See application file for complete search history.

(56) References Cited

U.S. PATENT DOCUMENTS

| | | | | |
|---|---|---|---|---|
| 5,150,242 | A * | 9/1992 | Fellows | 359/108 |
| 7,057,476 | B2 * | 6/2006 | Hwu | 333/187 |
| 7,397,301 | B1 * | 7/2008 | Brocato | 329/347 |
| 7,733,198 | B1 * | 6/2010 | Olsson et al. | 333/187 |
| 7,800,066 | B2 * | 9/2010 | Talghader | 250/338.1 |
| 7,825,366 | B2 * | 11/2010 | Barker et al. | 250/227.11 |
| 2002/0130311 | A1 * | 9/2002 | Lieber et al. | 257/1 |
| 2005/0117843 | A1 * | 6/2005 | Catchmark et al. | 385/37 |
| 2006/0097334 | A1 * | 5/2006 | Suzuki et al. | 257/431 |

OTHER PUBLICATIONS

U.S. Appl. No. 11/748,832, filed May 15, 2007.
Allison, S.C. et al, "A bulk micromachined silicon thermopile with high sensitivity", Sensors and Actuators A, vol. 104, 2003, pp. 32-39.
I. El-Kady et al, "Phononic band-gap crystals for radio frequency communications", Applied Physics Letter, vol. 92, (2008), 233504-1 thru 3.
R. H. Olsson, III et al, "Microfabricated phononic crystal devices and applications", Measurement Science and Technology, vol. 20, 2009, pp. 1-13.
Roy H. Olsson III et al, "Microfabricated VHF acoustic crystals and waveguides", Sensors and Actuators A, 2008, pp. 87-93.
Roy H. Olsson III et al, "Microscale Phononic Band-Gap Crystals and Devices", Eurosensors, Sep. 2008, pp. 3-8.
Derek M. Stein et al, "Feedback-controlled ion beam sculpting apparatus", Review of Scientific Instruments, vol. 75, No. 4, Apr. 2004, pp. 900-905.
Jiali Li et al, "Ion-beam sculpting at nanometer length scales", Letters to Nature, Nature, vol. 412, Jul. 2001, pp. 166-169.

* cited by examiner

*Primary Examiner* — Daniel Previl
(74) *Attorney, Agent, or Firm* — Kevin W. Bieg

(57) ABSTRACT

Phononic crystals that have the ability to modify and control the thermal black body phonon distribution and the phonon component of heat transport in a solid. In particular, the thermal conductivity and heat capacity can be modified by altering the phonon density of states in a phononic crystal. The present invention is directed to phononic crystal devices and materials such as radio frequency (RF) tags powered from ambient heat, dielectrics with extremely low thermal conductivity, thermoelectric materials with a higher ratio of electrical-to-thermal conductivity, materials with phononically engineered heat capacity, phononic crystal waveguides that enable accelerated cooling, and a variety of low temperature application devices.

9 Claims, 6 Drawing Sheets

$V_{out} = n(S_1-S_0)(T_0-T_1)$; n=# of couples per array

PHONONIC CRYSTAL DEVICES

CROSS-REFERENCE TO RELATED APPLICATION

This application claims the benefit of U.S. Provisional Application No. 61/035,148, filed Mar. 10, 2008, which is incorporated herein by reference.

STATEMENT OF GOVERNMENT INTEREST

This invention was made with Government support under contract no. DE-AC04-94AL85000 awarded by the U.S. Department of Energy to Sandia Corporation. The Government has certain rights in the invention.

FIELD OF THE INVENTION

The present invention relates to phononic crystals and, in particular, to nano-scale phononic crystals that can be used for thermal management and noise mitigation in devices.

BACKGROUND OF THE INVENTION

An acoustic or phononic bandgap is the phononic analog of a photonic bandgap, wherein a range of acoustic frequencies are forbidden to exist in a structured material. Phononic bandgaps are realized by embedding periodic scatterers in a homogeneous host matrix that propagates an acoustic wave. The scatterer material has a density and/or elastic constant that is different than that of the matrix material, leading to destructive interference of the acoustic wave when the lattice constant of the phononic crystal structure is comparable to the wavelength of the acoustic wave. If the interference is destructive, the energy of the acoustic wave is reflected back and the wave cannot propagate through the phononic crystal. This destructive interference creates the phononic bandgap. The bandgap center frequency, spectral width (i.e., the range of frequencies over which phonons cannot be transmitted through the material), and the depth (i.e., the amount of acoustic rejection inside the bandgap frequency region) are determined by the size, periodicity, and arrangement of the scattering inclusions in the matrix material and the material properties of the inclusions and matrix. In principle, the bandgap can be created at any frequency or wavelength simply by changing the size of the unit cell of the crystal. The spectral width of the phononic bandgap is directly related to the ratio of the densities and sound velocities in the different materials comprising the structure. In general, the larger the ratio, the wider the bandgap. Further, for two- or three-dimensional phononic crystals, the frequency and width of the bandgap will depend on the direction of propagation.

Recently, bulk wave acoustic bandgap devices have been fabricated using microelectromechanical systems (MEMS) technologies. Phononic crystals have been fabricated at frequencies as high as 1 GHz, using high acoustic impedance scattering inclusions, such as tungsten, in a low acoustic impedance background matrix, such as silicon dioxide, and have been shown to block phonon propagation through a synthetic material over a wide frequency range. See U.S. patent application Ser. No. 11/748,832 to Olsson et al., which is incorporated herein by reference. At the micro-scale, these phononic crystals are useful for acoustic isolation of devices, such as resonators and gyroscopes. Furthermore, by strategically locating defects in the phononic crystal through removal or distortion of the scattering inclusions, micro-acoustic waveguides, focusing, sensors, cavities, filters, and advanced acoustic signal processors can be realized. These devices have applications in communications, ultrasound, sensing and non-destructive testing.

However, a need remains for phononic crystal devices that can be used in thermal management and noise mitigation. Therefore, a need remains to scale this technology to terahertz (THz) frequencies, the frequency range where most thermally generated room temperature phonons propagate.

SUMMARY OF THE INVENTION

The present invention is directed to phononic crystals that have the ability to modify and control the thermal black body phonon distribution and the phonon component of heat transport in a solid. In particular, the thermal conductivity and heat capacity can be modified by altering the phonon density of states in a phononic crystal. This ability allows the development of useful devices and materials such as radio frequency (RF) tags powered from ambient heat, dielectrics with extremely low thermal conductivity, thermoelectric materials with a higher ratio of electrical-to-thermal conductivity, engineering of material heat capacity, accelerated cooling, and a variety of low temperature applications, such as low temperature testing and space applications.

An embodiment of the invention is a method and device for harvesting ambient thermal energy and converting it to electromagnetic (EM) energy emitted at radio frequencies for tagging, radar applications, and inter-chip communications. This harvesting is based on the ability of phononic crystals to modify the phonon density of states. Because of the periodic arrangement of scatterers in a phononic crystal, the superposition of Mie resonances and the Bragg condition result in opening of frequency gaps in which phonons are forbidden to propagate. This forces non-spontaneous multi-phonon processes to occur and result in the up/down conversion of phonon frequency in a quest to reach the allowed propagating mode frequency. By engineering the phononic crystal, multiple cascading forbidden bands and/or cascade independent phononic crystals can be achieved. Upon coupling the output of the phonon spectrum to a piezoelectric oscillator, the ambient thermal energy can be harnessed and converted to EM waves at the radio frequency.

Another embodiment of the invention is a thermoelectric material that exhibits high electrical conductivity and low thermal conductivity simultaneously. At THz frequencies, the phonon contribution to heat transport in a thermoelectric material can be removed, decreasing the thermal conductivity while leaving the electrical conductivity either unchanged or increased. Reaching the frequency range to significantly alter phononic heat transport through a thermoelectric material requires patterning of periodic structures on the nanometer length scale. Such materials can significantly enhance the efficiency of thermoelectric generators.

Another embodiment of the invention comprises a phononic bandgap thermoelectric cooler, comprising a phononic crystal waveguide in a dielectric material and means for imposing a temperature gradient across the waveguide.

Another embodiment of the invention comprises a phononic bandgap material having a tailored heat capacity, comprising a phononic crystal that modifies the phonon density of states of the material to provide a heat capacity that is not constant over temperature.

Another embodiment of the invention comprises a phonon shield, comprising a phononic crystal that encapsulates a device for shielding the device from thermal noise, wherein the phononic crystal has a phononic bandgap that overlaps the thermal noise in frequency.

BRIEF DESCRIPTION OF THE DRAWINGS

The accompanying drawings, which are incorporated in and form part of the specification, illustrate the present invention and, together with the description, describe the invention. In the drawings, like elements are referred to by like numbers.

DETAILED DESCRIPTION OF THE INVENTION

Figure 1B:
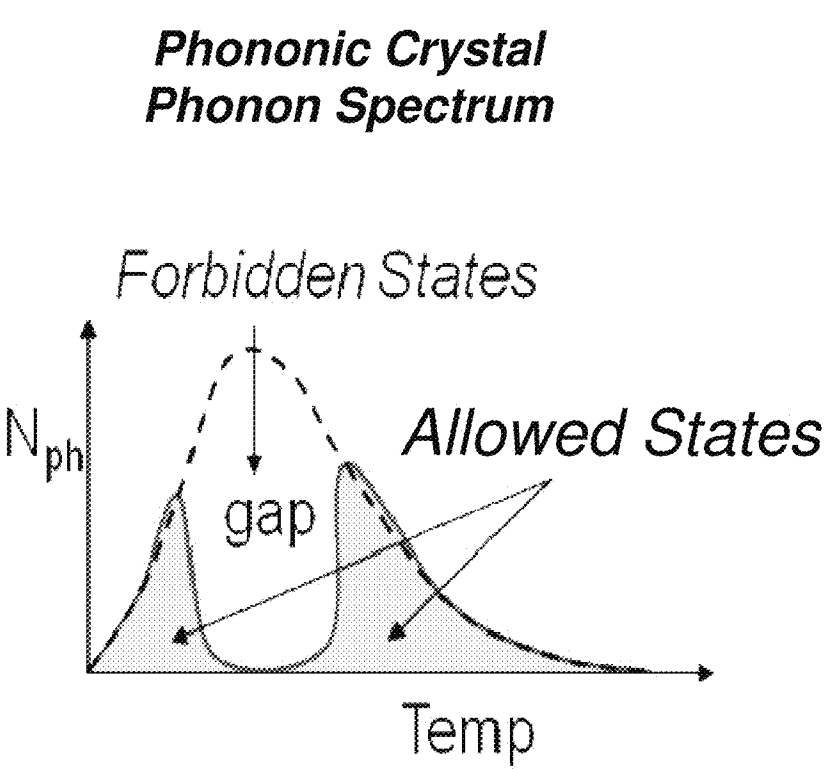
FIG. 1B is a schematic illustration of the phonon distribution is a phononic crystal.
Figure 1A:
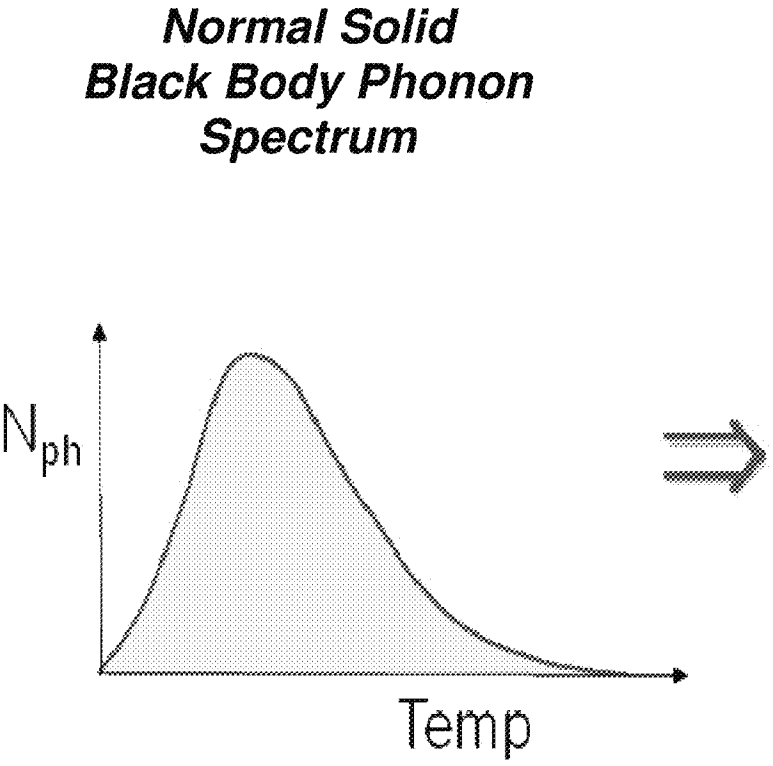
FIG. 1A is a schematic illustration of the black body phonon distribution in a conventional solid material.

Shown in FIG. 1A is the black body phonon distribution in a conventional solid material versus temperature. By altering the structure of the material to form a phononic crystal, a phononic bandgap can be realized in the material, as shown in FIG. 1B. This phononic bandgap forbids the existence of phonons in the material over a wide range of frequencies or equivalent temperatures and redistributes the thermally induced black body phonon spectrum in the material. Therefore, the thermal phonon distribution can be molded and shaped by artificially changing the density of states of the phononic crystal. Such phononic crystals can provide dielectrics with reduced thermal conduction, thermopiles that can scavenge thermal energy, thermoelectric coolers, materials with good electrical but poor thermal conduction, and devices that can shield Johnson noise.

Phononic crystals are formed by the periodic arrangement of scattering centers in a host matrix with a high acoustic impedance mismatch between the scattering centers and the host matrix. See R. H. Olsson III and I. El-Kady, *Measurement Science and Technology* 20, 012002 (2009), which is incorporated herein by reference. The frequency where the peak of the blackbody phonon distribution occurs depends on the temperature. For thermal management applications, a phononic bandgap is preferably located at the peak of the black body phonon distribution, which varies with temperature. However, at any given temperature, the thermal phonon distribution spans an infinitely large frequency range. Therefore, although a larger portion of phonons are affected if the bandgap is nearer the blackbody peak, some phonons will be affected even if the gap is not located at the peak, resulting in alteration of the thermal properties of the material.

As shown in Table 1, the location of the bandgap center frequency depends on the phononic crystal geometric parameters r, which is the radius of each inclusion, and a, which is the lattice constant or pitch of the inclusions in a 2D square lattice phononic crystal. At low temperatures/frequencies, i.e., below 0.5K/10 GHz, a phononic crystal can be formed using micromachining and optical lithographic techniques developed by the integrated circuits industry. See R. H. Olsson III, I. El-Kady and M. R. Tuck, *EUROSENSORS* 2008, pp. 3-8, September 2008, which is incorporated herein by reference. Utilizing advanced techniques, such as electron beam and focused ion beam lithography, nano-scale phononic crystals at temperatures/frequencies as high as 125K/2.5 THz can be fabricated. Phononic crystals centered at room temperature can be formed by techniques such as ion implantation, diffusion and self-assembly. See Stein et al., *Rev. Sci. Inst.* 75(4), 900 (2004); and Li et al., *Nature* 412, 166 (2001), which are incorporated herein by reference.

TABLE 1

Relationship of Location of Phononic Bandgap to Phononic Crystal Geometric Parameters

| Center Frequency | Scatterer Radius (r) | Lattice Pitch (a) | Phonon Temperature (T) |
|---|---|---|---|
| 50 MHz | 50 μm | 100 μm | 2.5 mK |
| 5 GHz | 0.5 μm | 1 μm | 0.25 K |
| 10 GHz | 250 nm | 500 nm | 0.5 K |
| 100 GHz | 25 nm | 50 nm | 5 K |
| 1 THz | 2.5 nm | 5 nm | 50 K |
| 2.5 THz | 1 nm | 2 nm | 125 K |

A large number of devices are enabled by phononic crystals and the interaction of phononic crystals with thermally generated phonons (as opposed to previous work in which phonons were injected into the phononic bandgap structures using piezoelectric materials, acoustic horns and lasers).

Figure 2:
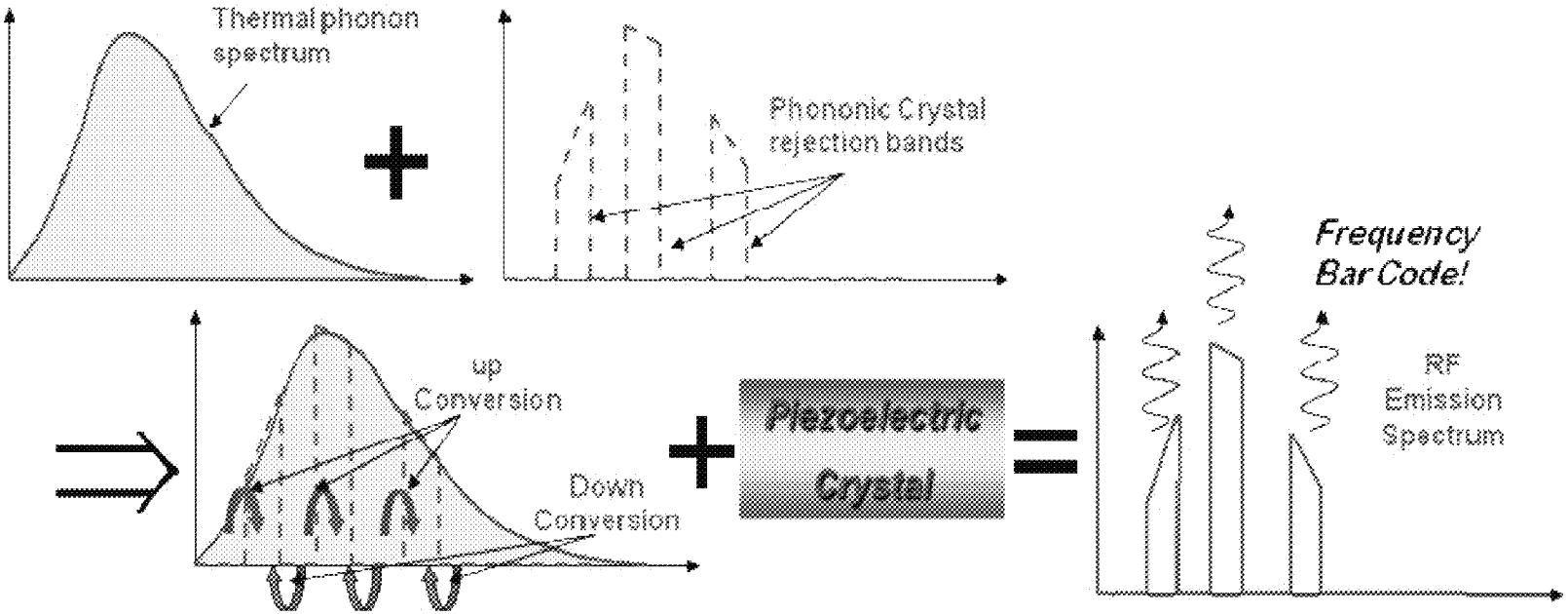
FIG. 2 is a schematic illustration of a radiofrequency identification tag powered by ambient thermal energy.

An embodiment of the invention comprises harvesting ambient thermal energy and converting it to electromagnetic (EM) energy emitted at the radio frequency for tagging. Shown in FIG. 2 is a schematic illustration of a method to create an RF tag powered by ambient thermal energy. In the RF tag, a phononic crystal is used to suppress or reject thermally generated phonons in certain frequency bands. The phononic crystal can be engineered to possess single or multiple rejection (i.e., stop) bands whose boundaries lie at a desired harvesting frequency. The depleted density of states in the rejection bands force multi-phonon processes to perform up/down frequency conversion, allowing phonons to escape in the allowed bands. The lattice can be acoustically coupled to a piezoelectric crystal to generate an electromagnetic radio signal, as described in the above referenced U.S. patent application Ser. No. 11/748,832 to Olsson et al. For example, crystals of different periods can be cascaded or a single crystal with multiple higher order bands (overtones) can be used to generate multiple rejection bands. Phononic crystal sections with different lattice constants and scatterer radii or different phononic crystal lattices (e.g., square, hexagonal, or honeycomb lattices) can be cascaded. Alternatively, multiple gaps can be created in the same crystal by introducing a sequence of defects. Thermal phonons not in one of the frequency bands suppressed by the phononic crystal interact with and displace the piezoelectric crystal to generate an electromagnetic radio signal. Examples of such piezoelectric materials include aluminum nitride, zinc oxide, quartz, lithium niobate, lithium tantalite, barium strontium titanate (BST), and lead zirconate titanate (PZT). The interaction of the piezoelectric material with the thermal phonons creates an output voltage across a set of electrodes attached to the piezoelectric material at the frequencies where the phonons are not suppressed by the phononic crystal. This voltage signal can then be electromagnetically transmitted via an antenna and measured remotely forming a radiofrequency identification (RFID) tag powered by ambient thermal energy. The location of the rejection bands can be different for each tag, resulting in a frequency bar code that can be used to identify the tag.

Another embodiment of the invention is a thermoelectric material that exhibits high electrical conductivity and low thermal conductivity simultaneously. In either energy scavenging or sensing applications, it is advantageous to have thermocouple materials with low thermal conductivity so that a large thermal gradient can be maintained across the thermocouple and a large voltage present at the output. Similarly, high electrical conductivity is desired for thermocouple materials. The noise floor of a thermocouple sensor is inversely proportional to the electrical conductivity of the materials used to form the thermocouple. Similarly, the source resistance of a thermoelectric energy harvesting device is inversely proportional to the electrical conductivity of the materials used to form the thermocouple. With higher electrical conductivity in a thermocouple, more power can be harvested from a given temperature gradient. The larger the Seebeck coefficient, the larger the voltage developed across the thermoelectric material for a given temperature gradient. Therefore, the desired properties of thermoelectric materials are large Seebeck coefficient, high electrical conductivity, and low thermal conductivity.

Thus, thermoelectric devices such as thermocouples have improved performance when the electrical conductivity of the materials used is as high as possible and the thermal conductivity of these materials is as low as possible. Unfortunately, this combination is not readily found in nature. Materials such as metals have high electrical and high thermal conductivity. Dielectric materials generally have low electrical conductivity and can have low to high thermal conductivity. Semiconductors generally have only moderate electrical conductivity and can have moderate to high thermal conductivity.

Figure 3A:
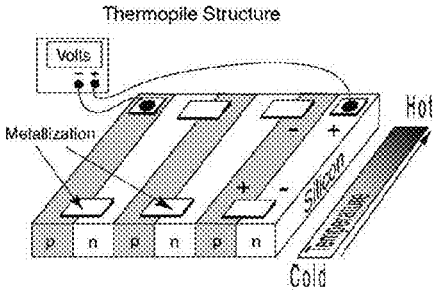
FIGS. 3A-D are schematic illustrations of a conventional thermopile structure, a conventional thermocouple, a phononic bandgap thermocouple, and a phononic bandgap thermopile comprising an array of phononic bandgap thermocouples for scavenging thermal energy.
Figure 3B:
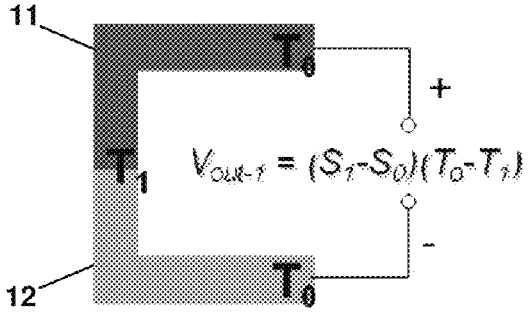

Therefore, another embodiment of the invention is directed to thermoelectric materials comprising phononic crystals that can exhibit high electrical conductivity and low thermal conductivity simultaneously. FIGS. 3A-D show a conventional thermopile structure, a conventional thermocouple, a phononic bandgap thermocouple, and a phononic bandgap thermopile comprising an array of phononic bandgap thermocouples for scavenging thermal energy. FIG. 3A shows a conventional thermopile comprising an array of thermocouples connected in series (as shown) or parallel, used for measuring temperature or generating current. As shown in FIG. 3B, a thermocouple is formed by combining two materials 11 and 12 with different Seebeck coefficients, S. When a temperature gradient is present across the thermocouple, as shown by $T_0$ and $T_1$, an output voltage is generated:

$$V_{out\text{-}1}=(S_1-S_0)(T_0-T_1).$$

Figure 3C:
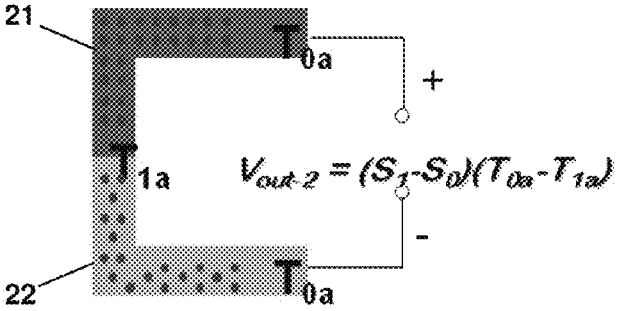

As shown in FIG. 3C, the ratio of electrical-to-thermal conductivity of a thermoelectric material or device can be improved by using phononic bandgap thermocouple materials. In this embodiment, a thermocouple junction can be formed by two thermoelectric materials with a large difference in Seebeck coefficient for example n-type and p-type silicon. The doping level is high to ensure high electrical conductivity. See S. C. Allison et al., *Sensors and Actuators A* 104, 32 (2003), which is incorporated herein by reference. The thermal conductivity through the thermoelectric materials is due to electron and phonon transport. A periodic arrangement of scattering centers (e.g., air hole inclusions) can be introduced in the thermocouple materials 21 and 22 to form a phononic bandgap thermocouple. By placing a phononic crystal in each thermoelectric material, the phonon component of heat transport can be reduced with a corresponding reduction in the thermal conductivity without impacting (or in some cases even increasing) the electrical conductivity, which is only due to electron flow in the material. This improves the thermoelectric figure of merit, $Z_T=(\sigma_{elect}/\sigma_{th})S^2T$. The phononic bandgap enables simultaneous low series resistance (i.e., low losses) and high thermal isolation (i.e., high $\Delta T$ and $\Delta V$). When a temperature gradient is present across the phononic bandgap thermocouple, as shown by $T_{0a}$ and $T_{1a}$, an output voltage is generated:

$$V_{out\text{-}2}=(S_1-S_0)(T_{0a}-T_{1a})$$

Figure 3D:
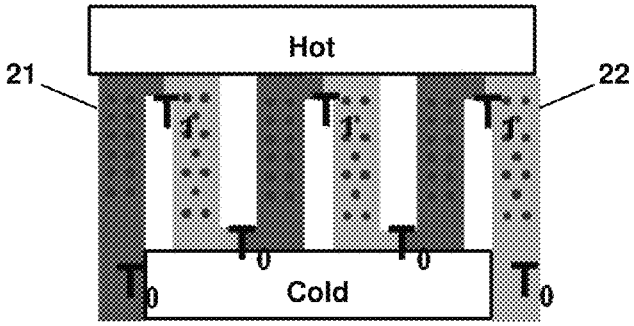

Since $(T_{0a}-T_{1a})>(T_0-T_1)$ then $V_{out\text{-}2}>V_{out\text{-}1}$. In this way a thermocouple can be used to turn ambient thermal gradients into electrical energy or to sense temperature. FIG. 3D shows a phononic bandgap thermopile comprising an array of phononic bandgap thermocouples connected in series. With this embodiment, the output voltage is:

$$V=n(S_1-S_0)(T_0-T_1)$$

where n is the number of phononic bandgap thermocouples in the array. Therefore, assuming an array comprising one-hundred n-type silicon (S=−450 mV/° C., ρ=0.0035 W-cm) and p-type silicon (S=+450 mV/° C., ρ=0.0035 W-cm) phononic bandgap thermocouples and a temperature gradient of 100° C., the output voltage generated can be about one volt. As described previously, the bandgap is preferably as wide as possible with a center frequency as close as possible to the peak of the blackbody phonon distribution at the operational temperature of the thermocouple. However, the thermal conductivity can be suppressed even if the center frequency and the blackbody peak do not coincide.

Figure 4B:
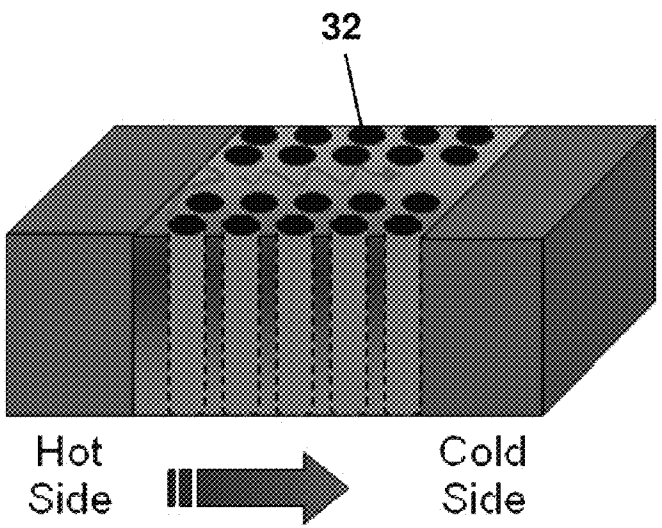
FIG. 4B is a schematic illustration of a phononic crystal waveguide that cools faster due to by ballistic phonons travel.
Figure 4A:
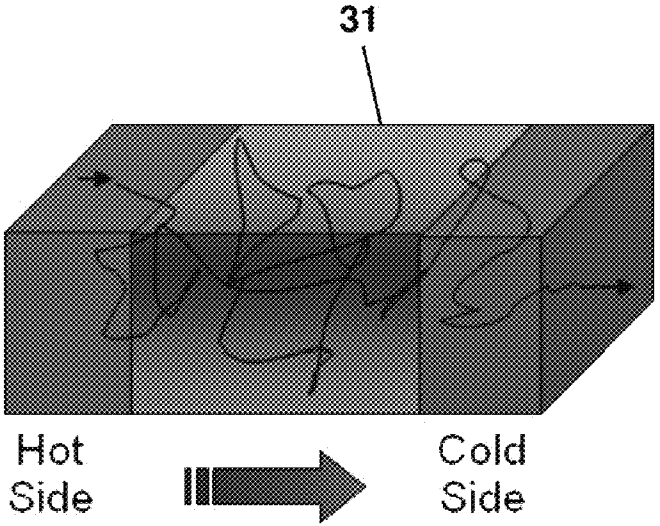
FIG. 4A is a schematic illustration of a conventional dielectric solid that cools by random phonon scattering.

Another embodiment of the invention uses phononic crystals to improve the efficiency of thermoelectric coolers, also known as Peltier coolers. As shown in FIG. 4A, cooling in a conventional dielectric solid 31 due to random phonon scattering is limited by the phonon drift velocity, $v_d$. A phonon group velocity $v_g$ that is higher than the drift velocity $v_d$ in a bulk material can be achieved with a phononic crystal waveguide. The waveguide can be a multimode waveguide with close to linear dispersion via the removal of multiple rows of scatterers. The waveguiding ability will exist in any phononic crystal regardless of symmetry (i.e., square, hexagonal, or honeycomb) provided that enough periods of an unperturbed lattice exist on both sides of the guide to allow for the existence of a phononic bandgap on either side of the guide. As shown in FIG. 4B, the phononic crystal waveguide 32 enables packets of phonons of various frequencies to propogate at speeds that are close to the bulk acoustic wave speed. The phonons travel ballistically in the phononic crystal waveguide faster than they can travel randomly in the bulk material, thus removing heat more quickly and accelerating the cooling process.

Figure 5:
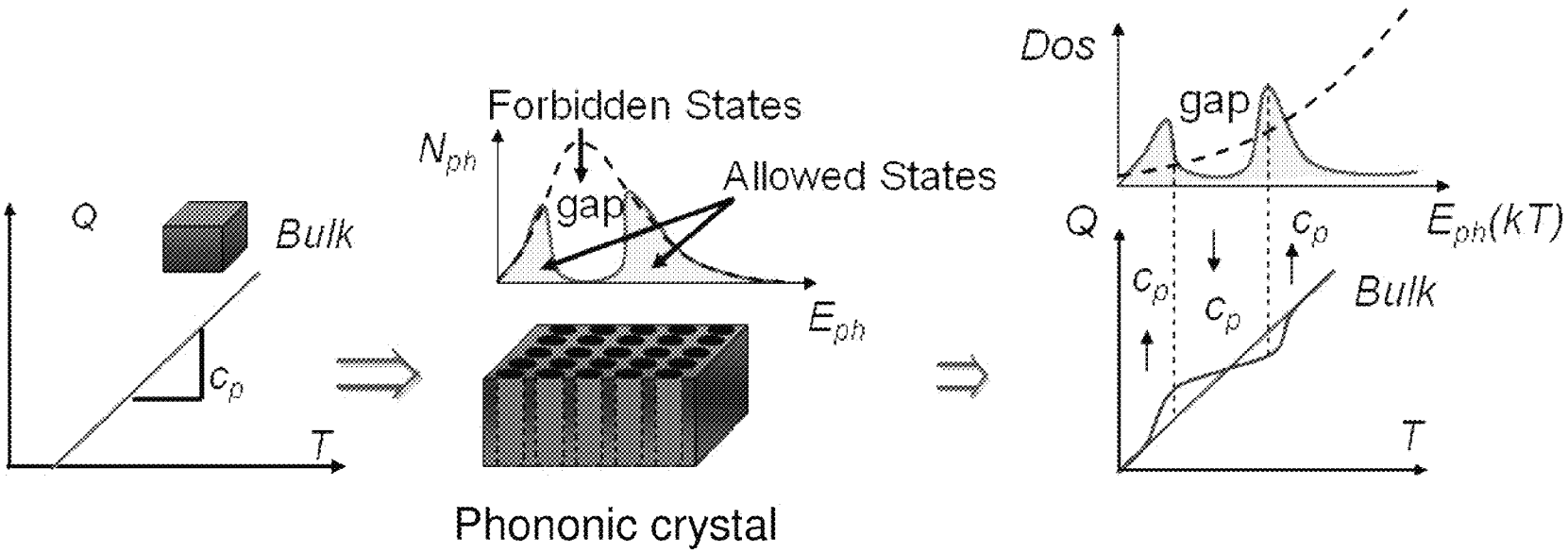
FIG. 5 is a schematic illustration of the use of a phononic crystal to modify the specific heat capacity of a material.

In another embodiment of the invention, phononic crystals are used to modify the specific heat capacity ($c_p$) of a material. Raising the temperature of a bulk solid material requires the addition of a constant amount of energy. Therefore, to raise the temperature 1° K requires the addition of a set amount of energy regardless of the temperature of the solid material. There are, of course, exceptions to this such as phase changes from solid to liquid, etc. Utilizing a phononic crystal to modify the phonon density of states can produce a material with a heat capacity that is not constant over temperature. As shown in FIG. 5, the phonon density of states (DOS) is very high in temperature/frequency regions just outside the phononic bandgap of the phononic crystal. In these regions, to increase the temperature of the material requires the addition of higher amounts of energy than in a bulk material with no phononic bandgap (i.e., increased $c_p$) since there are many states to fill. Inside the bandgap region, where few to zero phonon states are permitted, the temperature can be raised by adding less energy than that required to increase the temperature of a bulk material (i.e., decreased $c_p$). Therefore, by utilizing phononic crystals, materials with a tailored heat capacity can be designed.

Figure 6:
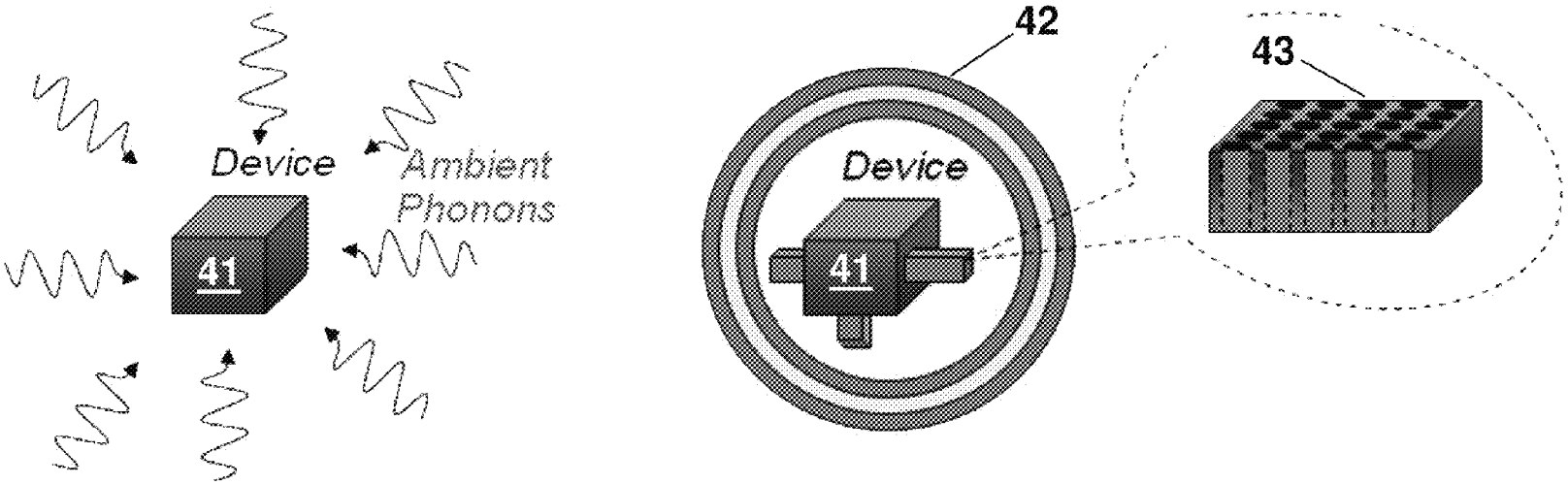
FIG. 6 is a schematic illustration of the use of phononic crystals to shield devices from thermal noise, also known as Johnson noise.

In another embodiment of the invention, phononic crystals can be used to shield devices from thermal noise (i.e., ambient phonons), also known as Johnson noise. As shown in the exemplary phonon shield in FIG. 6, the device 41 can be encapsulated in a 1D phononic crystal 42 that shields the phonons from the ambient thermal white noise that is rejected due to the existence of a phononic bandgap that overlaps the noise in frequency. The shielded device can also be anchored, for example using a 2D phononic crystal 43, thereby reducing noise that can propagate through the anchors. The phonon shield can be used to shield sensitive oscillator-based devices such as gyroscopes, accelerometers, bolometer and any MEMS based resonators.

The present invention has been described as phononic crystal devices. It will be understood that the above description is merely illustrative of the applications of the principles of the present invention, the scope of which is to be determined by the claims viewed in light of the specification. Other variants and modifications of the invention will be apparent to those of skill in the art.

We claim:

1. A radiofrequency identification tag device, comprising:

a phononic crystal that suppresses thermally generated phonons in one or more frequency bands, and a piezoelectric crystal acoustically coupled to the phononic crystal that generates a voltage signal at one or more frequencies where the thermal phonons are not suppressed by the phononic crystal.

2. The radiofrequency identification tag device of claim 1, further comprising an antenna for electromagnetically transmitting the voltage signal.

3. The radiofrequency identification tag device of claim 1, wherein the phononic crystal comprises cascaded phononic crystal sections with different lattice constants or different crystal lattice types.

4. The radiofrequency identification tag device of claim 1, wherein the phononic crystal comprises a sequence of defects.

5. A phononic bandgap thermocouple, comprising:

a first thermocouple material having a first phononic crystal structure that suppresses thermally generated phonons in one or more frequency bands, and a second thermocouple material having a second phononic crystal structure that suppresses thermally generated phonons in one or more frequency bands, and wherein the first and second thermocouple materials form a thermocouple junction.

6. The phononic bandgap thermocouple of claim 5, wherein the first and second thermocouple materials comprise n-type and p-type silicon.

7. The phononic bandgap thermocouple of claim 5, further comprising at least one addition phononic bandgap thermocouple connected in series or parallel with the phononic bandgap thermocouple to provide a phononic bandgap thermopile.

8. A phononic crystal waveguide, comprising a two-dimensional periodic arrangement of scattering centers in a dielectric material host matrix with a high acoustic impedance mismatch between the scattering centers and the host matrix, wherein at least one row of the scattering centers is removed to provide a phononic crystal waveguide and means for imposing a temperature gradient across the at least one removed row of scattering centers the waveguide.

9. The phononic crystal waveguide of claim 8, wherein multiple rows of scattering centers are removed to provide a multimode waveguide.

* * * * *